US005836353A

United States Patent [19]

Van Steenwyk

[11] Patent Number: 5,836,353

[45] Date of Patent: Nov. 17, 1998

[54] VALVE ASSEMBLY FOR BOREHOLE TELEMETRY IN DRILLING FLUID

[75] Inventor: Donald H. Van Steenwyk, San Marino, Calif.

[73] Assignee: Scientific Drilling International, Inc., Houston, Tex.

[21] Appl. No.: 712,275

[22] Filed: Sep. 11, 1996

[51] Int. Cl.[6] ..... G01V 1/52

[52] U.S. Cl. ..... 137/624.15; 137/599.1; 175/50; 251/30.01; 251/61.1

[58] Field of Search ..... 137/599.1, 624.15; 166/66, 113, 373; 175/50; 251/61.1, 30.01

[56] References Cited

U.S. PATENT DOCUMENTS

| | | | |
|---|---|---|---|
| 2,380,520 | 7/1945 | Hassler . | |
| 2,677,790 | 5/1954 | Arps . | |
| 2,787,759 | 4/1957 | Arps . | |
| 2,898,088 | 8/1959 | Alder | 175/50 |
| 2,925,251 | 2/1960 | Arps . | |
| 3,302,457 | 2/1967 | Mayes . | |
| 3,408,561 | 10/1968 | Redwine et al. . | |
| 3,571,936 | 3/1971 | Taylor, Jr. . | |
| 3,693,428 | 9/1972 | Le Peuvedic . | |
| 3,711,825 | 1/1973 | Claycomb . | |
| 3,736,558 | 5/1973 | Cubberly . | |
| 4,386,422 | 5/1983 | Memby . | |
| 4,401,134 | 8/1983 | Dailey . | |
| 4,550,392 | 10/1985 | Mumby . | |
| 4,578,675 | 3/1986 | MacLeod | 166/66 |
| 4,621,655 | 11/1986 | Roche | 251/61.1 |
| 4,645,174 | 2/1987 | Hicks | 251/61.1 |
| 4,742,498 | 5/1988 | Barron . | |
| 4,901,290 | 2/1990 | Feld et al. . | |
| 4,905,778 | 3/1990 | Jurgens . | |
| 5,040,155 | 8/1991 | Feld . | |
| 5,073,877 | 12/1991 | Jeter . | |
| 5,115,415 | 5/1992 | Mumby et al. . | |
| 5,182,731 | 1/1993 | Hoelscher et al. . | |
| 5,357,483 | 10/1994 | Innes . | |
| 5,375,098 | 12/1994 | Malone . | |

*Primary Examiner*—Stephen M. Hepperle
*Attorney, Agent, or Firm*—Baker & Botts, L.L.P.

[57] ABSTRACT

Pressure pulses in a flowing stream are generated by movement radially of an elastomer membrane surrounding a perforated tube. Movement outward of the membrane is initiated by closing of a pilot valve in the tube, but is accelerated by pressure increases from decreasing flow area around the membrane. Opening of the pilot valve allows the membrane to return to its collapsed condition. Selection of flow area around the expanded membrane allows selection of pulse amplitude. Signals from a variety of downhole instruments are provided to a driver of the pilot valve, so that pressure pulses from operation of the membrane can be detected uphole in a well.

14 Claims, 4 Drawing Sheets

VALVE ASSEMBLY FOR BOREHOLE TELEMETRY IN DRILLING FLUID

FIELD OF THE INVENTION

This invention relates to data telemetry through a fluid flowing in a tubular. More particularly, valve apparatus and method are provided for generating pressure pulses which may be coded to transmit data.

BACKGROUND OF THE INVENTION

Measurements of drilling parameters and logs to measure properties of the surrounding strata are common while drilling wells. These measurements are taken by various instruments mounted within the drill string. Measurements of the direction of the drill bit have become particularly important in recent years with the growth in number of directional and horizontal wells. It has also been realized that transmission of logging data to the surface while drilling offers advantages over conventional wireline logging. Data are usually transmitted up-hole to the earth's surface from the vicinity of the bit, but may be transmitted up-hole to intermediate devices which then transmit the data on to the surface.

Various schemes have been proposed for telemetry of downhole data while drilling a well. One proposed technique transmits measurements by means of electrical wirelines which extend through the drill string. This scheme has been successful in industry, but requires a wireline extending through the surface connection that provides power to turn the drill string. More than 50 years ago, in U.S. Pat. No. 2,380,520 to Hassler, it was suggested that the data be transmitted through a series of sound signals or vibrations in the drilling fluid, eliminating the need for electrical cables. In 1957, Arps suggested that pressure pulses in drilling fluid be generated by effecting a variable resistance to flow of drilling fluid through a flow restriction in the lower end of a drill string (U.S. Pat. No. 2,787,759). Arp's variable resistance to flow is created when an elongated body having a varying outside diameter is moved in an axial direction relative to a concentric body having a varying inside diameter and a flow channel is formed between the two bodies. Movement of the internal body is effected by an electrical actuator.

During ensuing years a variety of means have been suggested for creating pressure changes or pressure pulses downhole for telemetry of data to the surface. U.S. Pat. No. 2,925,251 discloses apparatus wherein drilling fluid flows through a cylinder having elastic walls and pressure pulses outside the cylinder cause a decrease in fluid flow area of the cylinder which results in pressure pulses in the flowing stream. The pressure pulses propagate upstream to the surface and are detected as signals.

A commonly-used mechanism in the prior art to create pressure variations is illustrated in U.S. Pat. No. 3,408,561. A valve stem is moved axially in response to an electrical signal, thereby varying flow area between the valve stem and an orifice. Upward movement of a conical shape valve toward a seat to create pulses is illustrated in U.S. Pat. No. 3,693,428, whereas downward movement of the valve toward a seat to generate pressure pulses is illustrated in U.S. Pat. No. 3,711,825. The downward-facing valve was intended to decrease electrical power requirements for operation of the valve (or pulser). In U.S. Pat. No. 3,711,825, a valve in which fluid flow force on a first body assists in shifting a cylindrical valve to close ports and create a pressure pulse, while the valve is opened by spring action, is described. Another apparatus for reducing electrical power requirements for creating pressure pulses downhole is disclosed in U.S. Pat. No. 3,736,558. Means for generation of electrical power downhole is also illustrated in this disclosure, along with a valve mechanism employing coaxial movement.

Hard particles such as sand may, at times, be present in drilling fluid. Flow of these particles through valves or pulsers may interfere with operation of the valve, so it is known to employ inlet filters which remove particles large enough to interfere with valve action. Such filter is illustrated in U.S. Pat. No. 5,040,155. The main valve in the device of the '155 patent is operated after a pilot valve closes to increase pressure across a part of the main valve serving as a piston, which pushes the valve in a direction to decrease flow area and create a pressure increase. Pilot valve action is a common means of activating downhole signaling valves, and is described, for example, in U.S. Pat. Nos. 4,401,134 and 4,742,498.

In more recent years a variety of signal transmitters have been developed for generating pressure pulses by rotational motion in a cylindrical housing to change flow area of the drilling fluid. U.S. Pat. No. 5,182,731 discloses such apparatus, which includes axially aligned fluid passages and a disc-shaped rotor disposed between the passages. The rotor moves between a first and second limit position to vary flow area of the drilling fluid. For the drive of the rotor there is provided a reversible DC motor which is connectable to a battery or downhole electrical generator by way of a time-controlled switch gear unit. U.S. Pat. No. 5,357,483 also discloses a rotatable elongate body having a plurality of blades spaced around the body, such that rotation of the body between first and second positions affects the pressure in the drilling fluid upstream of the apparatus.

When mud pulsers or valves of variable area are used in a drilling fluid stream as a means of transmitting data to the surface of the earth, it is desirable that the pulsers operate under a wide range of properties of the drilling fluid and a wide range of flow rates of the fluid. Properties of the drilling fluid and flow rates vary throughout a drilling operation as different drilling conditions are encountered in the borehole and different fluid compositions are used to perform the drilling process. Flow rates may vary from about 50 to about 1500 gallons per minute, for example, and drilling fluid density may vary from about the density of water to more than twice the density of water. Solid particles in the fluid may vary in size over a broad range. Pressure variations in the drilling fluid may be created from a variety of sources, such as pumps and equipment movement, so the "noise level" in a stream of drilling fluid in a tubular during drilling operations may be quite high.

There is a continuing need for improved apparatus for generating pressure pulses in a fluid stream which requires less power for creating the pressure pulses, which has a long life and is easy to repair, and which can create pressure pulses in the stream having an amplitude which provides ease of detection of pressure signals under a wide variety of drilling conditions, drilling fluid properties and noise levels encountered in drilling a well.

SUMMARY OF THE INVENTION

There is provided apparatus and method for generating pressure pulses in a flowing stream within a tubular by inflation of a polymeric membrane surrounding a conduit through which a part of the flowing stream may be directed and in which the flow can be interrupted. The conduit is supported in the tubular and extends from upstream to downstream of a flow restriction between the conduit and inside wall of the tubular. Pressure pulses in the conduit are created by closing and opening of a pilot valve downstream of a perforation in the conduit. The perforation is covered by the membrane, so that fluid can flow through the perforation to inflate the membrane. Inflation of the membrane further decreases cross-sectional flow area of the stream, creating pressure pulses of greater magnitude. The membrane may inflate to a radius determined by mechanical properties of the membrane or the membrane may be confined upon inflation within an outer coaxial cylinder. The membrane is preferably made from an elastomer. An upstream filter may be provided at the entry to the conduit. The pilot valve used to vary pressure within the conduit may be any valve suitable for varying the flow rate of the fluid to form pressure pulses; preferably it uses minimum electrical power. In another embodiment, a second valve is placed in the conduit upstream of the perforation and is operated so as to improve control of membrane movement when flow in the stream is at a high rate.

In yet another embodiment, clean fluid within the membrane is provided by using a floating piston to separate the membrane fluid from the drilling fluid flowing in the stream. The pilot valve inside a conduit is opened and closed as before to create pressure pulses, which drive the piston and cause the membrane to move.

DETAILED DESCRIPTION OF PREFERRED EMBODIMENT

Figure 1:
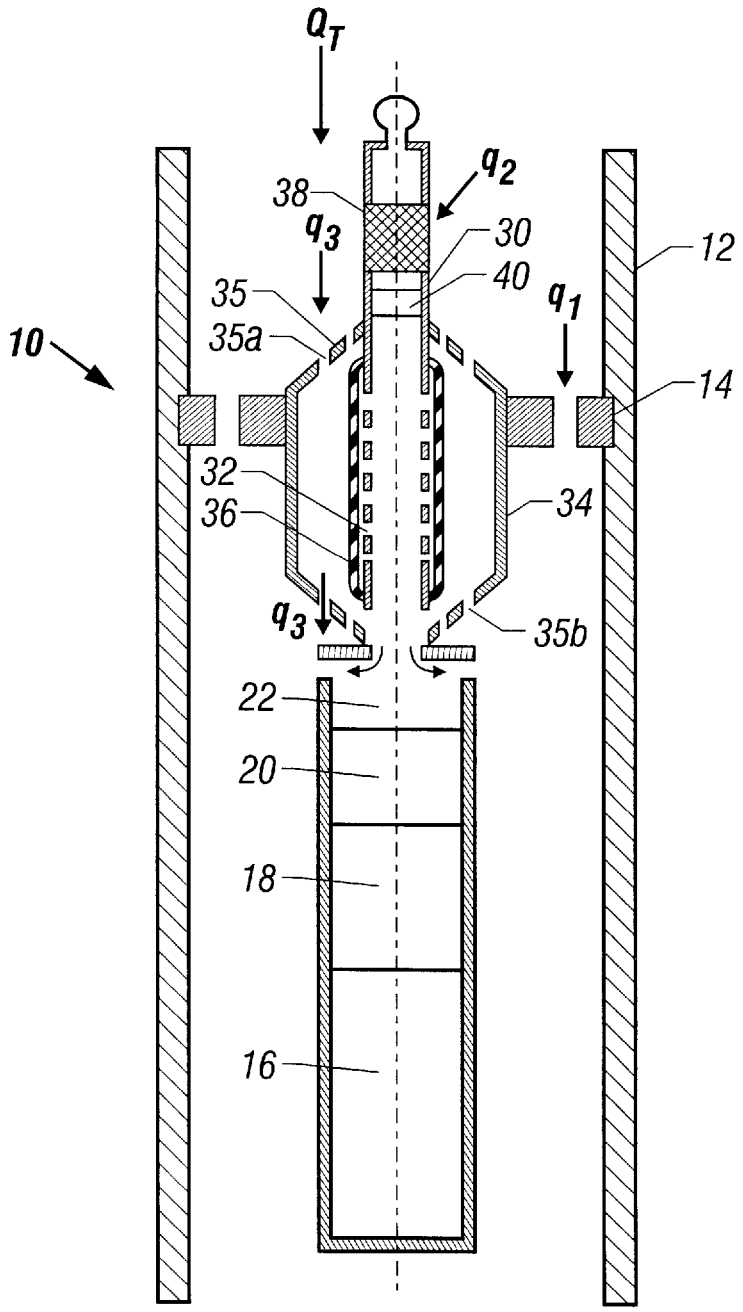
FIG. 1 is a cross-section view of one embodiment of a downhole tool for generating pressure pulses in drilling fluid with the membrane in the collapsed position.

Referring to FIG. 1, downhole telemetry apparatus 10 is supported in tubular 12 by restrictor 14, which is fixed to tubular or drill pipe 12 by known apparatus. Restrictor 14 may be made from a "Totco Ring," for example, and may contain an alignment device such as a muleshoe. Flow passages 15 through restrictor 14 may be sized to provide a selected cross-sectional flow area and hydraulic resistance to flow of the drilling fluid at expected flow rates in tubular 12. Restrictor 14 may also be fixed to tubular 12 by other means, well known in the art, and may be set before tubular 12 is placed in the well or may be set later by wireline. Likewise, apparatus 10 may be designed to be placed in a well in two parts, the first part being restrictor 14 and the second part being the remainder of apparatus 10, which may be placed by wire line or tubing and landed in restrictor 14. The apparatus of this invention may be used in vertical, directional or horizontal wells. The cross-sectional flow area or hydraulic resistance of restrictor 14 is selected to provide a pressure pulse having a selected amplitude which can be detected in the presence of noise in the well but not so great an amplitude as to cause excessive erosional wear or damage to equipment. Sensors 16 and microcontroller 18 are electrically connected and powered. Power for movement of pilot valve 22 is provided by driver 20. Signals from detectors 16 are also electrically fed to microcontroller 18. Such signals may include, for example, but not by way of limitation: measurements of hole direction such as from gyroscopes or gyroscopic devices; measurements of drilling data such as pressure, temperature, or bit speed; and, data obtained from logging instruments, flux gate magnetometers, accelerometers, or any other sensors. Data received by microcontroller 18 are encrypted into a time-dependent series of pulses, using techniques known in the art. Signals from microcontroller 18 are then used to control valve driver 20. Electrical power is provided from batteries included in the downhole equipment (not shown) or from a downhole generator. Such devices are known in the art. By opening and closing pilot valve 22 under control of the time-dependent signals, a time dependent stream of pressure pulses is coded to transmit data through the drilling fluid stream. Pilot valve 22 may be any valve apparatus which operates to create a positive pressure pulse in conduit 30. It may be a poppet valve or a valve operating by rotation of a shaft, or any other type valve known in the art. The pilot valve will preferably be selected for its low consumption of electrical power. The main valve of this invention, in the form of a polymeric membrane expanded in response to operation of the pilot valve, is activated by hydraulic power in the flowing stream, as further explained hereafter.

As indicated in FIG. 1, total flow rate of drilling fluid down the drill pipe is $Q_T$. Flow is initially split into three segments: $q_1$ through the passages of restrictor 14, $q_2$ through filter 38 and tube 30, and $q_3$ between bladder 36 and restrictor 14. Pressure pulses are generated by movement of pilot valve 22, which closes or partially closes to greatly decrease or eliminate $q_2$. According to the method and apparatus of this invention, the magnitude of the pressure pulses generated by closing and opening of pilot valve 22 is greatly amplified by the concomitant expansion of membrane 36 upon closure or partial closure of valve 22. Membrane 36 is expanded because fluid pressure inside the membrane increases upon closure of valve 22 to a value approximating the pressure upstream of restrictor 14; flow of fluid then occurs from inside tube 30 through perforations 32 and into the bladder which is formed by the membrane. The pressure across membrane 36 tending to expand the bladder approximates the pressure drop across restrictor 14. Upon expansion of membrane 36, $q_3$ is greatly decreased. The effect of membrane 36 expanding is to divert all or a part of flow $q_3$ through the passages in restrictor 14, thus amplifying the pressure increase of the pulse. Upon opening of valve 22, membrane 36 collapses on tube 30 and pressure decreases to its initial value. Thus, the primary source of energy to create the pressure pulses is supplied by the flowing stream, and only the relatively small amount of energy necessary to open and close the pilot valve must be supplied from electrical energy.

Filter 38 at the inlet of conduit 30 is employed to prevent particles in the drilling fluid interfering with operation of valve 22. Cuttings of rock or particles of sand should be excluded from the valve. One of the advantages from having the elastomeric membrane 36 as the main valve, i.e., the valve which causes a major part of the pressure changes in the stream which constitute a pulse to transmit a signal, is that the large opening around the membrane when it is collapsed allows relatively large particles to pass through the valve without affecting its operation.

In one embodiment, the maximum extension of membrane 36 is limited by frame 34. Frame 34 may be a cylindrical tube supported concentrically around tube 30 by end plates 35. The end plates may be perforated by a large number of holes 35(*a*) and 35(*b*) to provide low resistance to flow. Alternatively, the end plates may be solid and holes may be placed in the cylindrical tube of frame 34 near the upper and lower ends of the tube. In either embodiment, the holes are placed on opposite sides of restrictor 14. Membrane 36 may be formed from an elastomeric polymer or may be formed from a non-elastomeric polymer made into a folded construction to allow expansion. Suitable elastomers include VITON, NEOPRENE and other materials which may be selected for the temperature and fluid conditions expected in the wells in which the apparatus is to be used. Such elastomers are known in the art of well logging and well completion equipment.

When pilot valve 22 is closed or moved toward the closed position, pressure inside tube 30 increases. When the pressure inside tube 30 becomes greater than pressure in the fluid contacting the outside of membrane 36, the membrane begins expanding. Upon movement of membrane 36, pressure inside the membrane is increased further because of constriction of the space between the membrane and the wall of frame 34. Therefore, movement of the membrane is a self-generating process, resulting in very rapid closure or partial closure of the flow path for $q_3$. With membrane 36 extended to cover either the upper openings 35(*a*) or lower openings 35(*b*), flow through frame 34, $q_3$, is essentially stopped, thus leaving only one flow channel downward through drill pipe 12 and downhole telemetry apparatus 10—the flow channel through passages 15 of restrictor 14.

Alternatively, membrane 36 may be inflated to a preferred position such that pressure drop and differences in pressure drop across assembly 10 are maintained at a preferred signal level at different rates of drilling fluid flow through tubular 12. At higher flow rates, less movement of bladder 36 is required to generate signals having a selected amplitude. The preferred position of membrane 36 in its maximum extended position may be limited by mechanical limitations of membrane movement such as by movement of a portion of frame 34 radially. Such movement may be activated in response to a signal from microcontroller 18 so as to control pulse amplitude.

In another embodiment, if total flow rate $Q_T$ is expected to be unusually high, auxiliary valve 40 (FIG. 1) may be placed in tube 30 upstream of perforations 32. The purpose of this valve is to prevent pressure across membrane 36 becoming high enough to partially inflate membrane 36 even with pilot valve 22 in the open position. Operation of apparatus 10 will be such that valve 40 will be opened when a pressure pulse is to be generated, or as valve 22 is closed. Valve 40 may be actuated by the same driver as valve 22, or may be actuated by a separate driver (not shown). The driver for valve 40 is preferably under control of microcontroller 18.

Figure 2:
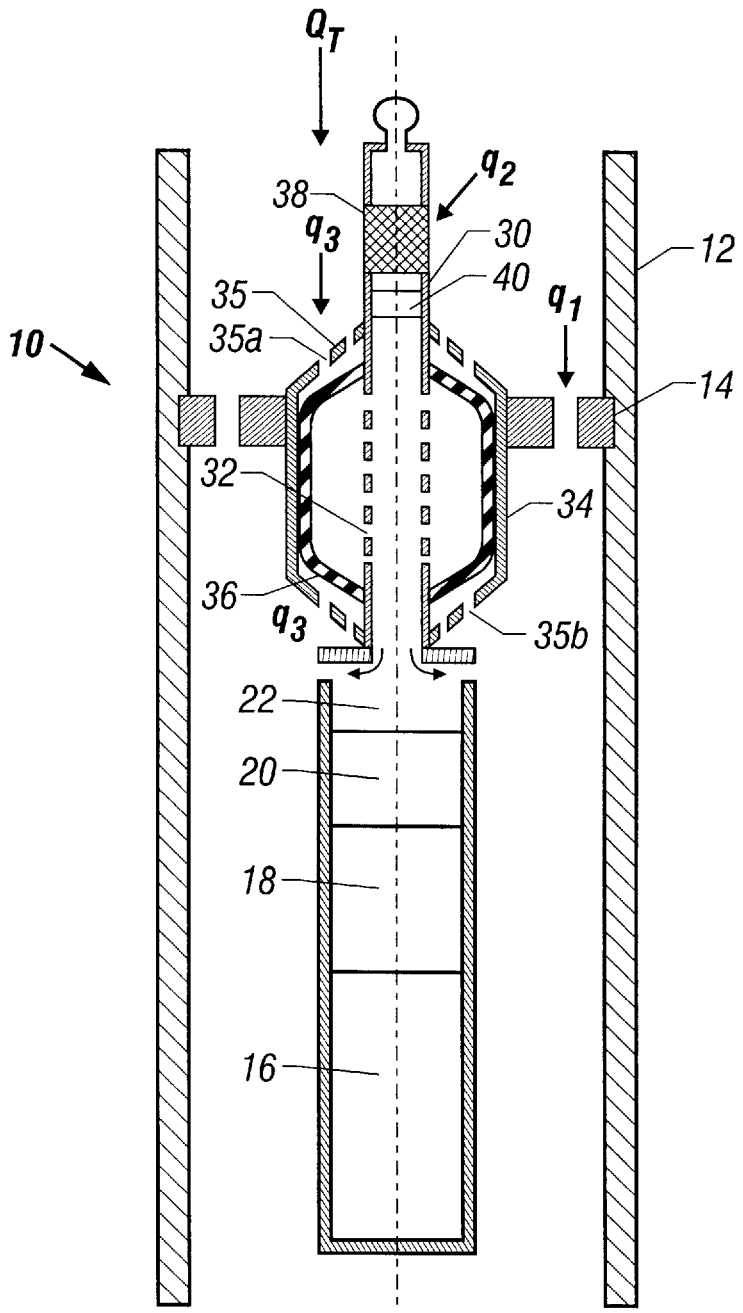
FIG. 2 is a cross-section view of the embodiment of FIG. 1 with the membrane in the inflated or radially extended position.

In FIG. 2, apparatus 10 is shown with membrane 36 in the radially extended or inflated position. Inflation has resulted from closing or partial closing of pilot valve 22, which decreased or eliminated flow $q_2$ and created a pressure across membrane 36 which caused fluid to begin to move the membrane radially outward. As this occurred, flow $q_3$ also began decreasing, which caused even higher rate of movement of membrane 36. Upon subsequent opening of pilot valve 22, membrane 36 will return to its position shown in FIG. 1.

Figure 3:
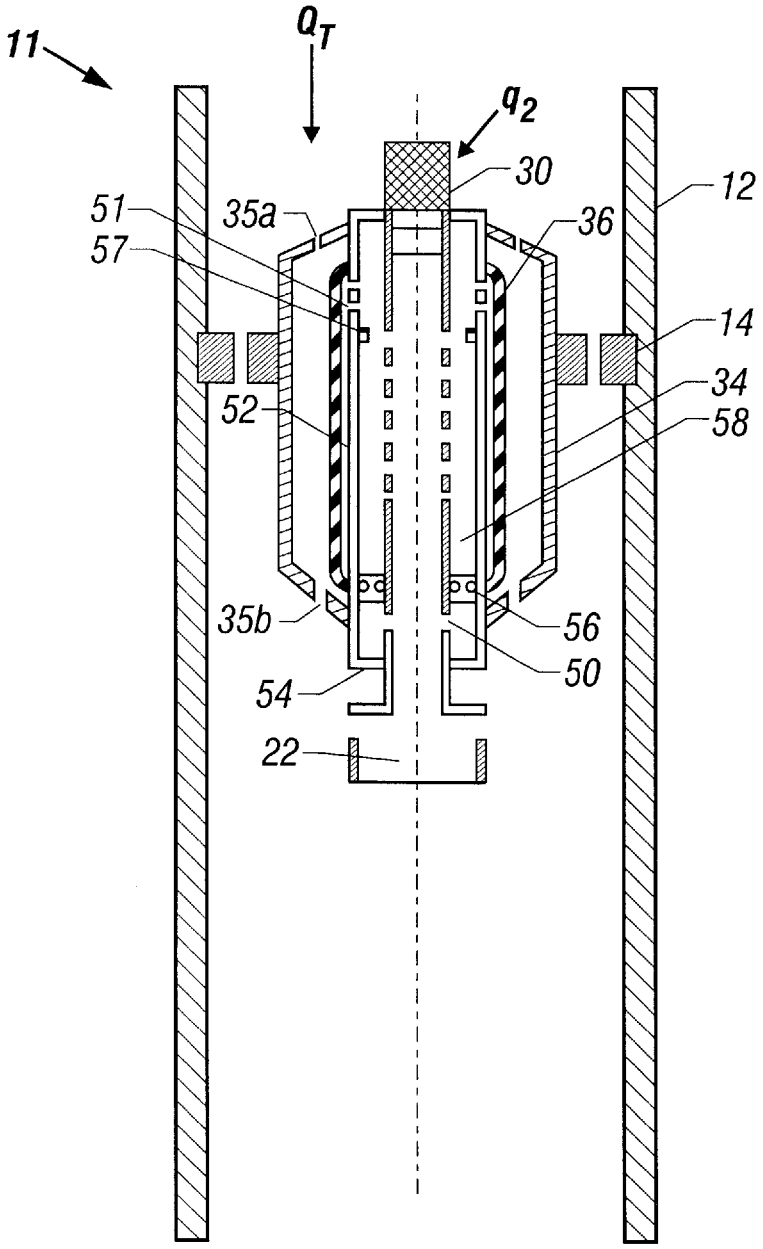
FIG. 3 shows an embodiment of the invention wherein a clean hydraulic fluid is used to inflate the membrane.

In an alternate embodiment, the position of an elastic member is moved by hydraulic fluid which is stored within the downhole apparatus. Referring to FIG. 3, telemetry apparatus 11 is shown. The same numerals designate parts analogous to the parts of FIG. 1. Apparatus 11 is supported by restrictor 14 in tubular 12. Actuation of pilot valve 22 causes buildup of pressure in tube 30. Ports 50 in tube 30 vent the pressure in tube 30 to an annulus outside tube 30, inside cylinder 52 and between plates 54. Cylinder 52 contains floating piston 56, which separates drilling fluid which has flowed through ports 50 from clean hydraulic fluid 58. A pressure increase from closing of pilot valve 22 causes movement of floating piston 56, forcing hydraulic oil through ports 51 into membrane 36 to create a pressure pulse as described above. In the embodiment shown in FIG. 3, outward movement of membrane 36 may be limited by frame 34. In an alternate embodiment, movement of membrane 36 is limited by stop 57, which may be placed so as to inflate membrane 36 to a selected position. The location of stop 57 may be adjusted in response to a signal from microcontroller 18 so as to adjust maximum radial movement of membrane 36 and thereby to adjust pulse amplitude.

EXAMPLE

Figure 4:
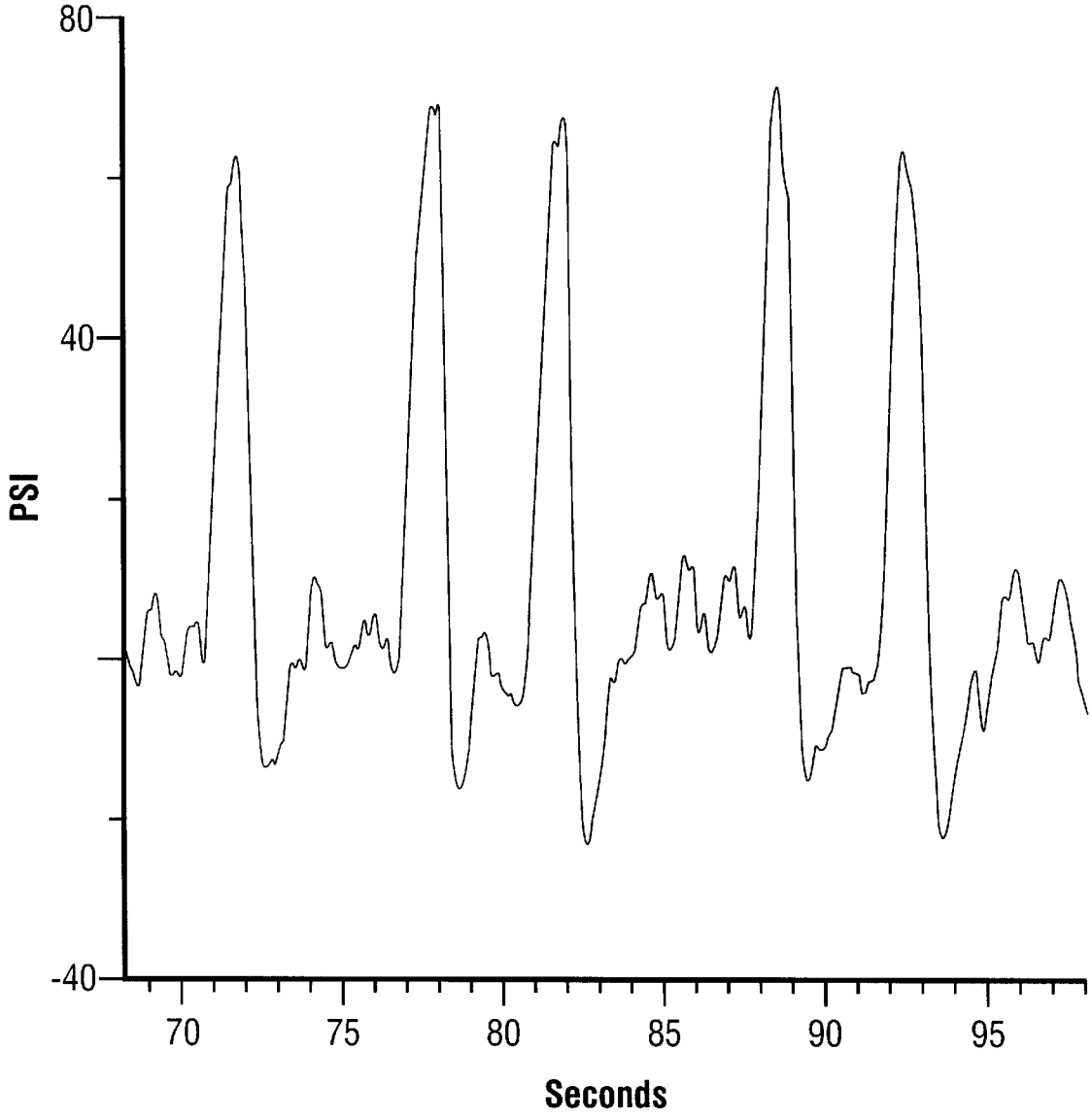
FIG. 4 shows pressure pulses created in a well by the apparatus of this invention.

Apparatus such as shown in FIG. 1 (without valve 40) was placed at a depth of 1000 feet in a well. The apparatus was attached inside a pipe having an inside diameter of 2 13/16 inch and fluid was pumped down the pipe at a rate of 350 gallons per minute. The flow area of the holes in the restrictor was 0.77 sq. inches (7 holes with a diameter of ⅜ inch), the outside diameter of the perforated tube was ½ inch and the inside diameter of the frame around the membrane was 1½ inches. The end plates of the frame were solid, and there were about 300 holes of diameter of 3/32 inch near the upper and lower ends of the tube of the frame. The pilot valve to shut off flow through the tube was operated by battery. The membrane was VITON rubber which was 0.050 inch thick. The membrane was 3½ inches in length in the collapsed condition. In response to signals from an attitude and inclination sensor package, the pilot valve was opened and closed to generate a series of pulses which were recorded at the surface using a conventional pressure transducer. FIG. 4 shows the results of the measurements. Pressure pulses having an amplitude of about 60 psi were observed and the rise time of the pulses was in the range of 0.1 second. This shows the response time of the membrane was sufficiently short to create pulses at a useful rate for transmission of data and the amplitude was sufficient to be detected even in the presence of high noise levels in the fluid.

The invention has been described with reference to its preferred embodiments. Those of ordinary skill in the art may, upon reading this disclosure, appreciate changes or modification which do not depart from the scope and spirit of the invention as described above or claimed hereafter.

What is claimed is:

1. Apparatus for generating pressure pulses in a fluid flowing in a tubular, comprising:

means for attaching the apparatus to an inside wall location of the tubular;

means for restricting flow in the tubular at the inside wall location;

a tube concentric within the means for restricting flow, the tube sized to conduct a selected portion of the fluid stream, the tube having a wall extending from upstream of the means for restricting flow to downstream of the means for restricting flow, the wall of the tube having a perforation in a selected segment of the tube, the segment being covered by a membrane capable of radial outward movement so as to form a bladder;

a pilot valve, the pilot valve being disposed in the tube downstream of the perforation and operably connected to a driver, the driver being electrically driven and adapted to move the pilot valve toward an open and a closed position in response to a signal from a downhole instrument;

a frame, the frame being disposed around the membrane and having an opening upstream of the means for restricting flow and an opening downstream of the means for restricting flow, such that flow through the frame is reduced when the membrane is moved radially outward; and a source of electrical energy.

2. The apparatus of claim 1 further comprising a second valve in the tube, the second valve being upstream of the perforation in the tube and operably connected to a driver, the driver being adapted to move the second valve in response to the signal.

3. The apparatus of claim 1 wherein the membrane is made of an elastomer.

4. The apparatus of claim 1 wherein the tubular is a drill string.

5. The apparatus of claim 1 wherein the means for restricting flow in the tubular at the inside wall location is a ring having a flow passage therethrough.

6. The apparatus of claim 5 wherein the area of the flow passage is selected to provide pressure pulses having a selected amplitude under selected flow conditions through the tubular.

7. The apparatus of claim 1 wherein the frame comprises a cylindrical body having flow openings upstream and downstream of the means for restricting flow in the tubular.

8. The apparatus of claim 1 further comprising means for adjusting the distance of radial outward movement of the membrane so as to adjust amplitude of pulses.

9. Apparatus for generating pressure pulses in a fluid flowing in a tubular, comprising:

means for attaching the apparatus to an inside wall location in a tubular;

means for restricting flow in the tubular at the inside wall location;

a tube concentric within the means for restricting flow, the tube sized to conduct a selected portion of the fluid stream, the tube having a wall extending from upstream of a means for restricting flow to downstream of the means for restricting flow, the wall of the tube having a perforation in a selected segment of the tube, the segment being covered by a membrane capable of radial outward movement so as to form a bladder;

a cylinder outside and concentric to the tube and forming an annulus between the tube and the cylinder, the cylinder having a wall and closed ends so as to form a vessel, the wall of the cylinder having a perforation in a selected segment of the wall;

a free piston in the annulus, the piston being capable of slidable movement along the annulus and being disposed between the perforation in the wall of the tube and the perforation in the wall of the cylinder and separating a fluid in the annulus from the fluid stream;

a membrane capable of radial outward movement so as to form a bladder, the membrane being outside the cylinder and disposed so as to cover the perforation in the wall of the cylinder;

a pilot valve, the pilot valve being disposed in the conduit downstream of the perforation and operably connected to a driver, the driver being electrically driven and adapted to move the pilot valve toward an open and a closed position in response to a signal from a downhole instrument;

a frame, the frame being disposed around the membrane and having an opening upstream of the means for restricting flow and an opening downstream of the means for restricting flow, such that flow through the frame is reduced when the membrane is moved radially outward; and a source of electrical energy.

10. The apparatus of claim 9 further comprising a second valve in the tube, the second valve being upstream of the perforation in the tube and operably connected to a driver, the driver being adapted to move the second valve is response to the signal.

11. The apparatus of claim 9 further comprising a stop in the annulus to limit movement of the free piston.

12. The apparatus of claim 9 wherein the tubular is drill pipe.

13. The apparatus of claim 9 wherein the membrane is an elastomer.

14. The apparatus of claim 9 further comprising means for adjusting distance of radial outward movement of the membrane so as to adjust pulse amplitude.

* * * * *